US012790805B2

(12) United States Patent
Li et al.

(10) Patent No.: US 12,790,805 B2
(45) Date of Patent: Nov. 10, 2026

(54) WALL-WETTING SPRAYER, SMART TOILET COVER, AND BIDET

(71) Applicant: Xiamen Standori Industry & Trade Co., Ltd, Xiamen (CN)

(72) Inventors: Junxin Li, Xiamen (CN); Zhanxian Chen, Xiamen (CN)

(73) Assignee: Xiamen Standori Industry & Trade Co., Ltd, Xiamen (CN)

( * ) Notice: Subject to any disclaimer, the term of this patent is extended or adjusted under 35 U.S.C. 154(b) by 58 days.

(21) Appl. No.: 19/190,839

(22) Filed: Apr. 28, 2025

(65) Prior Publication Data

US 2026/0160053 A1 Jun. 11, 2026

(30) Foreign Application Priority Data

Dec. 9, 2024 (CN) ..... 202423029860.6
Mar. 19, 2025 (CN) ..... 202520482181.X

(51) Int. Cl.
*E03D 9/08* (2006.01)

(52) U.S. Cl.
CPC ..... *E03D 9/08* (2013.01)

(58) Field of Classification Search
CPC ..... E03D 9/08
See application file for complete search history.

(56) References Cited

U.S. PATENT DOCUMENTS

2021/0348374 A1* 11/2021 Sun ..... E03D 3/00

FOREIGN PATENT DOCUMENTS

| | | | | |
|---|---|---|---|---|
| CN | 212755457 U | | 3/2021 | |
| CN | 213174012 U | | 5/2021 | |
| CN | 213204351 U | | 5/2021 | |
| CN | 213268184 U | | 5/2021 | |
| CN | 115354725 A | * | 11/2022 | ..... E03D 1/38 |

* cited by examiner

*Primary Examiner* — Christine J Skubinna
(74) *Attorney, Agent, or Firm* — Nitin Kaushik

(57) ABSTRACT

The present invention provides a wall-wetting sprayer, a smart toilet cover, and a bidet and relates to the technical field of sanitary products. The wall-wetting sprayer includes a rod body provided with a water inlet flow channel and a housing sleeved on the rod body. A bottom surface of the housing is provided with a spray hole, and a drainage surface that inclines outward is formed along a circumference of the spray hole. The rod body and the housing are matched to form an acceleration cavity, and at least one water inlet groove communicated with the water inlet flow channel is formed along a circumferential direction of the acceleration cavity, to enable a water flow to rotate for acceleration after entering the acceleration cavity from the water inlet groove, forming mist water to be spread and sprayed outward along the drainage surface from the spray hole.

11 Claims, 21 Drawing Sheets

WALL-WETTING SPRAYER, SMART TOILET COVER, AND BIDET

CROSS-REFERENCE TO RELATED APPLICATIONS

The application claims priority to Chinese patent application No. 2024230298606, filed on Dec. 9, 2024, and No. 202520482181X, filed on Mar. 19, 2025, the entire contents of which are incorporated herein by reference.

TECHNICAL FIELD

The present invention relates to the technical field of sanitary products, and specifically to a wall-wetting sprayer, a smart toilet cover, and a bidet.

BACKGROUND

The wall-wetting function of the toilet is mainly to coat the inner wall (pot surface) of the toilet with a layer of water film before the toilet is used, to prevent excrement from directly being in contact with the inner wall of the toilet, thereby reducing the possibility of dirt hanging and water splashing. Therefore, the use experience is more comfortable, and at the same time, stinky odors can be isolated to a certain extent to reduce the generation of unpleasant odors, and water can also be saved to a certain extent. Therefore, more and more smart toilets are provided with the wall-wetting function. Most of the structures of the existing wall-wetting sprayers are such as an atomizing sprayer for smart toilet wall wetting and a smart toilet provided with same that are disclosed in the Chinese patent CN213174012U. The atomizing sprayer includes a first acceleration flow channel that is vertically disposed and a spray hole that is located on a side surface of a bottom portion of the first acceleration flow channel. The atomizing sprayer can only spray liquid toward one side wall of the toilet, which is limited in spraying area and low in spraying efficiency, and is not conducive to the use of the user. In addition, since the spray hole is formed on the side surface of the sprayer, to prevent the water mist from splashing onto the user, the spray hole can only spray toward the side away from the human body. Therefore, the other parts of the inner wall of the toilet cannot be sprayed, resulting in a poor wall-wetting effect.

SUMMARY

The present invention discloses a wall-wetting sprayer, aiming to improve a problem that an existing wall-wetting sprayer is limited in spraying area, low in spraying efficiency, and poor in wall-wetting effect.

The present invention adopts the following solutions:

A wall-wetting sprayer, including a rod body provided with a water inlet flow channel and a housing sleeved on the rod body, where a bottom surface of the housing is provided with a spray hole, a drainage surface that inclines outward is formed along a circumference of the spray hole, the rod body and the housing are matched to form an acceleration cavity, and at least one water inlet groove communicated with the water inlet flow channel is formed along a circumferential direction of the acceleration cavity, to enable a water flow to rotate for acceleration after entering the acceleration cavity from the water inlet groove, forming mist water to be spread and sprayed outward along the drainage surface from the spray hole.

As a further improvement, the spray hole is formed along a center of the bottom surface of the housing and is located at a center of the acceleration cavity, and the drainage surface is an arc-shaped surface that is recessed from a periphery of an outer bottom surface of the housing toward the spray hole.

As a further improvement, the water inlet flow channel extends along an axial direction of the rod body, a side surface of the water inlet flow channel is provided with a water passing hole, a water passing channel configured to be communicated with the water passing hole is formed between an outer side wall of the rod body and an inner side wall of the housing, and the acceleration cavity is formed between an outer bottom surface of the rod body and an inner bottom surface of the housing.

As a further improvement, an annular flange is disposed along the outer bottom surface of the rod body, the annular flange abuts against the inner bottom surface of the housing to form the acceleration cavity, and the water inlet groove is formed on the annular flange and is obliquely formed along a circumferential direction of the annular flange.

As a further improvement, the rod body is in threaded connection with the housing, and a sealing ring configured to seal the water passing channel is disposed above the water passing hole.

As a further improvement, the water inlet flow channel is disposed with a cross section progressively decreasing along a water flow direction.

A smart toilet cover is provided additionally, including a cover plate, a seat plate, and the wall-wetting sprayer according to any one of the above disposed on the seat plate, where a switching valve configured to control connection and disconnection between a water inlet pipe and the water inlet flow channel is disposed on the seat plate.

As a further improvement, an assembly portion and a water inlet portion are disposed on an outer wall of the rod body in a protruding manner, the assembly portion is configured to be fixedly connected to the seat plate, and the water inlet portion is communicated with the water inlet flow channel and is connected to a water outlet end of a control valve through a hose.

A bidet is provided additionally, including a bidet main body configured to be fixed between a toilet seat and a seat plate and the wall-wetting sprayer according to any one of the above adapted and connected to the bidet main body.

As a further improvement, the bidet main body is provided with a valve cavity, a water inlet channel, a buttock washing flow channel, a feminine washing flow channel, a self-cleaning flow channel, and a pre-wetting flow channel, outlet ends of flow channels are provided with a buttock washing nozzle, a feminine washing nozzle, a self-cleaning nozzle, and the wall-wetting sprayer in a one-to-one correspondence, a first control valve and a second control valve are disposed in the valve cavity, the first control valve is configured to choose one flow channel from the buttock washing flow channel, the feminine washing flow channel, and the self-cleaning flow channel to be communicated with the water inlet channel, and the second control valve is configured to control connection and disconnection between the pre-wetting flow channel and the water inlet channel.

The present invention can obtain the following beneficial effects after adopting the above technical solutions:

1. After being accelerated by the acceleration cavity, the water flow can gain enough speed to be broken into small water drops or particles at the spray hole, forming the mist water to be sprayed toward an inner wall of a toilet to implement a wall-wetting function. The spray hole is formed on a bottom surface of the rod body to face a bottom portion of the toilet, so that the mist water can be sprayed onto the inner wall of the toilet from top to bottom. Compared with the prior art, a spraying angle of the wall-wetting sprayer is not limited by a position of the spray hole. Meanwhile, the drainage surface that inclines outward is formed along the circumference of the spray hole, so that the mist water can be spread and sprayed outward along the drainage surface, thereby increasing the spraying area, improving the wall-wetting efficiency, and further improving the wall-wetting effect.

2. The wall-wetting sprayer may control a flow rate through the switching valve to adjust a spraying range and may adapt to different water pressure, thereby reducing impacts of external water flow pressure on the wall-wetting effect.
3. The wall-wetting sprayer is disposed on the bidet main body, and the bidet main body is fixed between the toilet seat and the toilet cover plate, which does not affect structures of the toilet seat and the toilet cover plate, may be applied to most of the existing toilets, and is convenient for disassembly and assembly and for application in the aftermarket. Meanwhile, both control valves are mechanical valves and do not need to be connected to a power supply, which is conducive to mounting in a bathroom without a socket, may reduce mounting costs of the user, and may improve the market competitiveness of the bidet. In addition, compared with the smart toilet cover, the bidet has low costs and high cost performance, which is more conducive to being mounted on the existing toilet, to facilitate application of the wall-wetting function in the aftermarket.

BRIEF DESCRIPTION OF THE DRAWINGS

To describe the technical solutions in the embodiments of the present invention more clearly, the following briefly describes the accompanying drawings required for describing the embodiments. It should be understood that the following accompanying drawings show merely some embodiments of the present invention, and therefore should not be regarded as a limitation on the scope. Those of ordinary skill in the art may still derive other related accompanying drawings from these accompanying drawings without creative efforts.

REFERENCE NUMERALS

Figure 1:
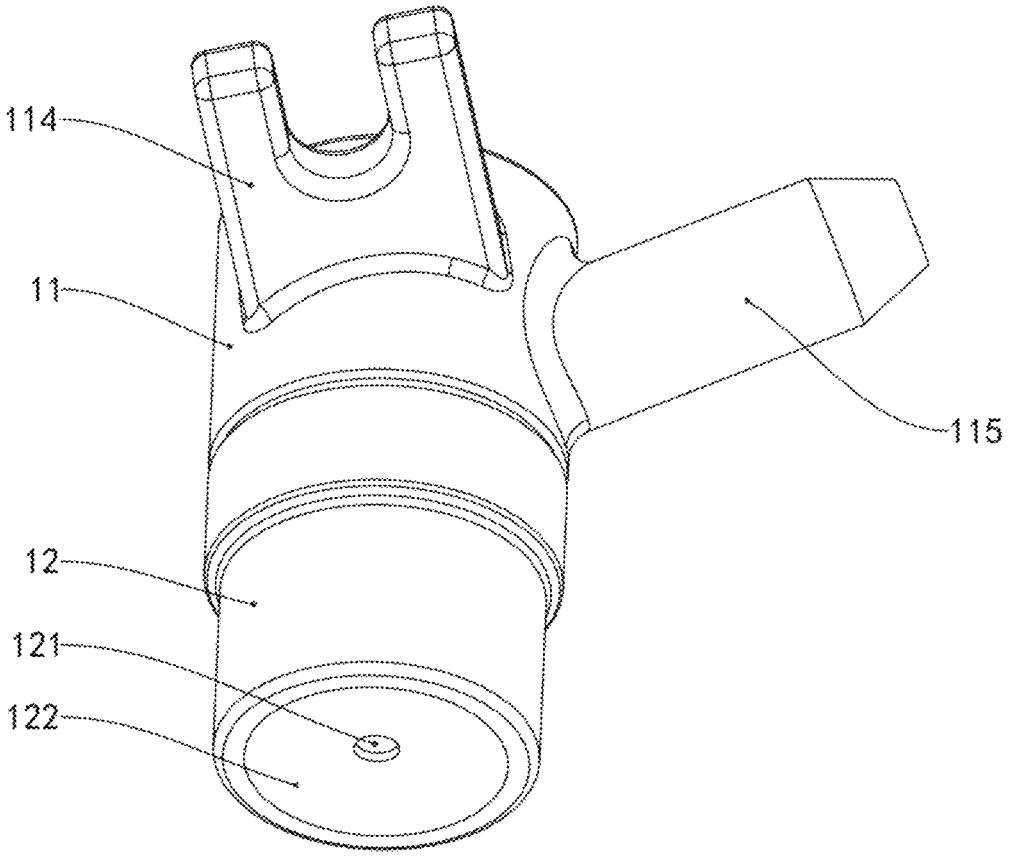
FIG. 1 is a schematic structural diagram of a wall-wetting sprayer according to an embodiment of the present invention.
Figure 2:
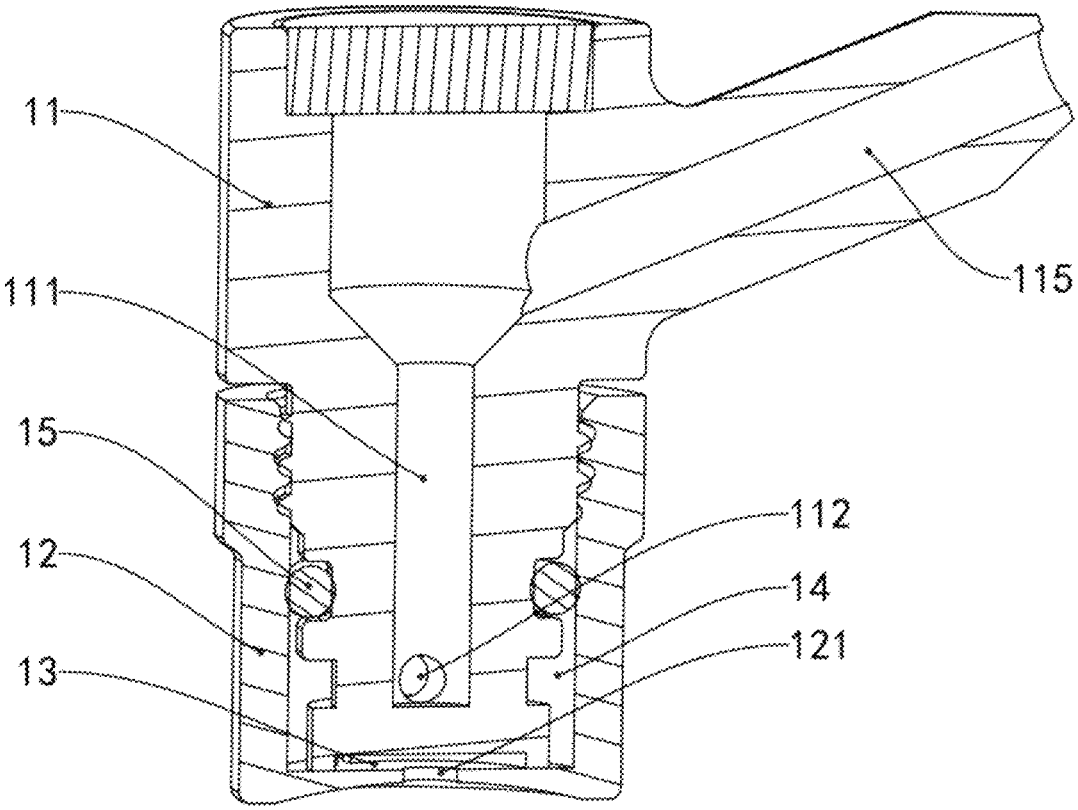
FIG. 2 and FIG. 3 are sectional views of a wall-wetting sprayer along different cross sections according to an embodiment of the present invention.
Figure 3:
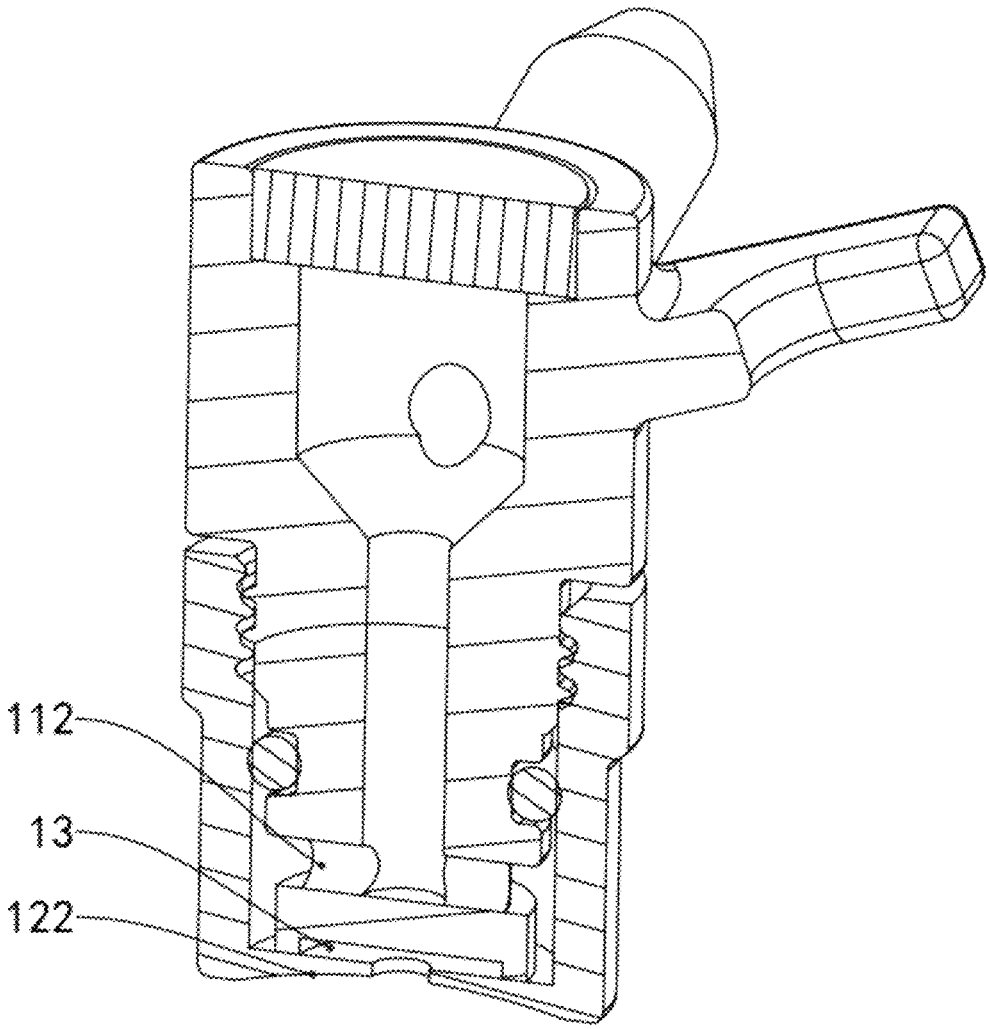
Figure 4:
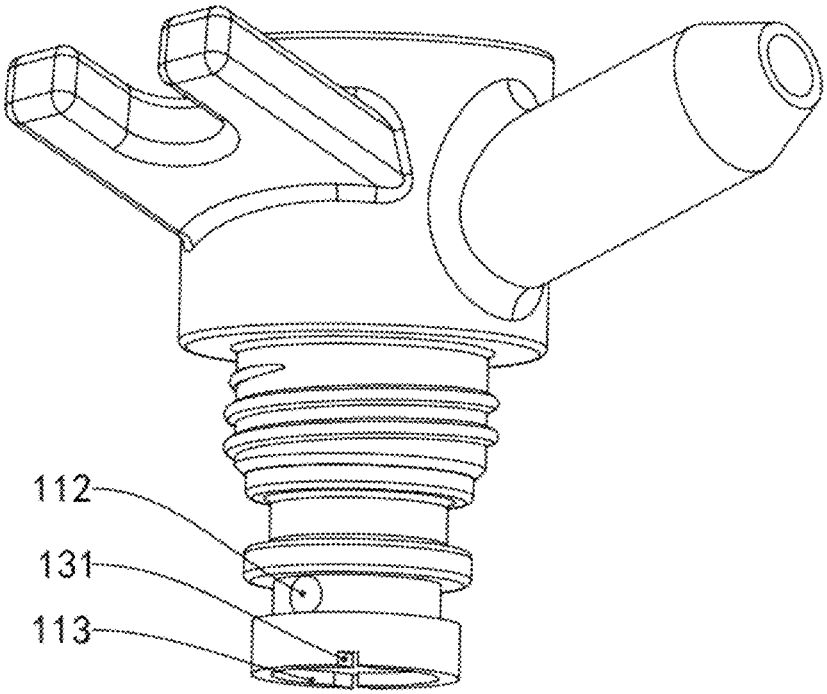
FIG. 4 and FIG. 5 are schematic structural diagrams of a rod body under different perspectives according to an embodiment of the present invention.
Figure 5:
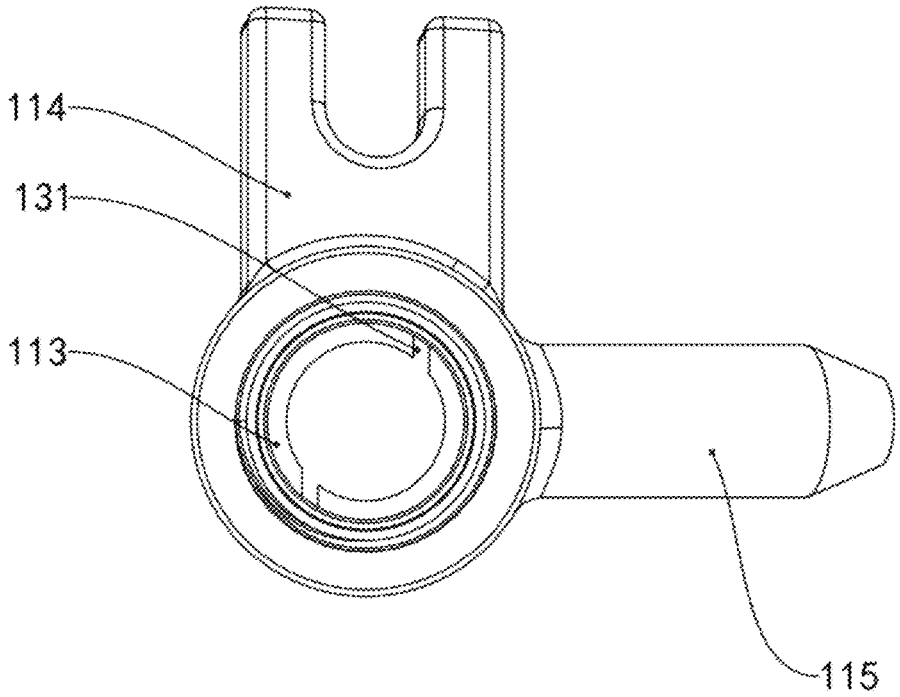
Figure 6:
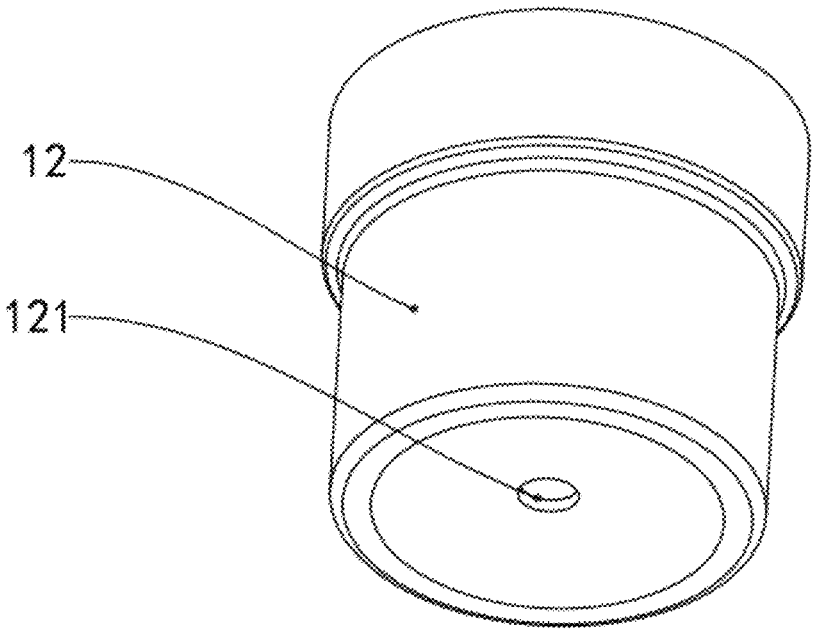
FIG. 6 is a schematic structural diagram of a housing according to an embodiment of the present invention.
Figure 7:
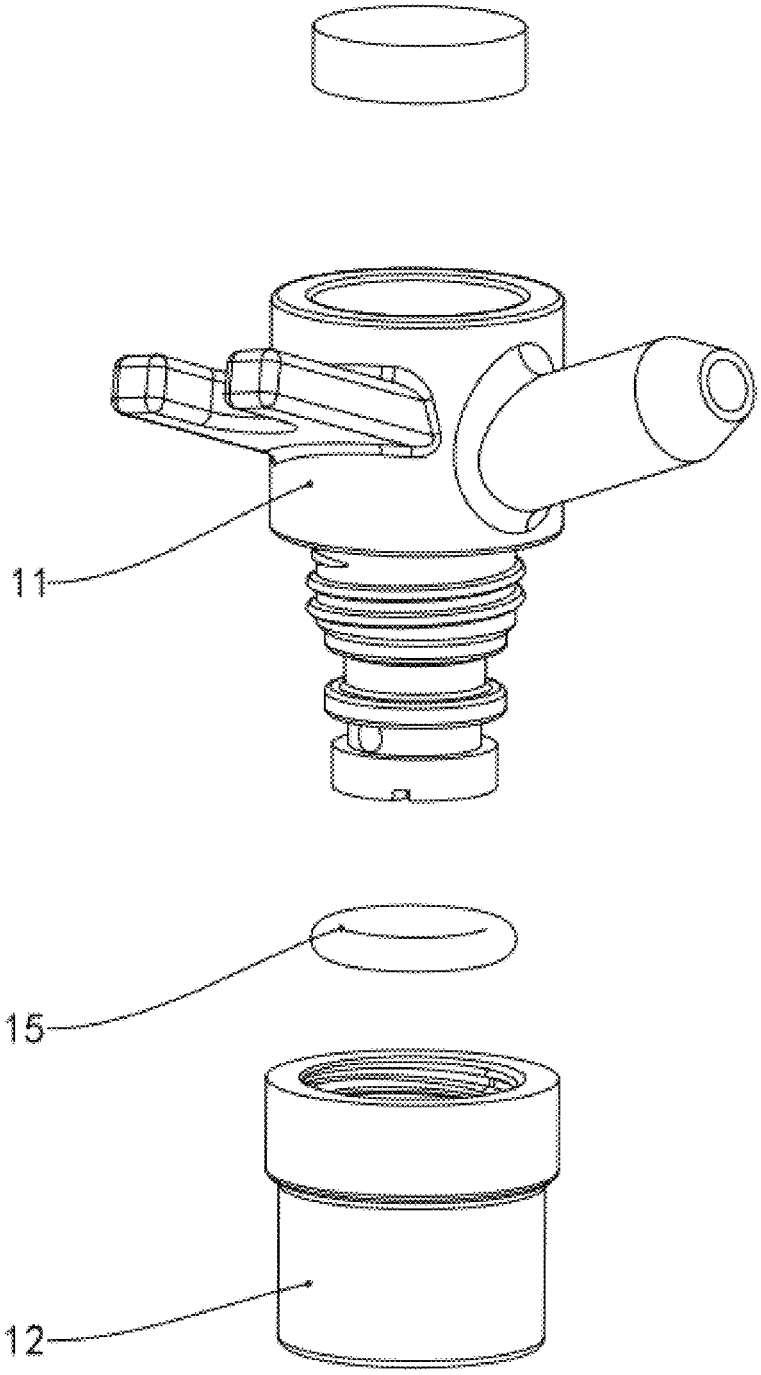
FIG. 7 is an exploded view of a wall-wetting sprayer according to an embodiment of the present invention.

1. wall-wetting sprayer; 11. rod body; 111. water inlet flow channel; 112. water passing hole; 113. flange; 114. assembly portion; 115. water inlet portion;
12. housing; 121. spray hole; 122. drainage surface; 13. acceleration cavity; 131. water inlet groove; 14. water passing channel; 15. sealing ring;
2. toilet cover; 21. cover plate; 22. seat plate; 221. switching valve; 222. screw post;
3. bidet main body; 31. valve cavity; 311. first control valve; 312. second control valve; 313. first water outlet; 314. second water outlet; 315. third water outlet; 316. fourth water outlet; 32. water inlet channel; 33. buttock washing flow channel; 331. buttock washing nozzle; 34. feminine washing flow channel; 341. feminine washing nozzle; 35. self-cleaning flow channel; 351. self-cleaning nozzle; 36. pre-wetting flow channel; 37. nozzle seat; 38. decorative cover.

DETAILED DESCRIPTION OF THE EMBODIMENTS

To make the objectives, technical solutions, and advantages of the embodiments of the present invention clearer, the following clearly and completely describes the technical solutions in the embodiments of the present invention with reference to the accompanying drawings in the embodiments of the present invention. Apparently, the described embodiments are some but not all of the embodiments of the present invention. Based on the embodiments in the present invention, all other embodiments obtained by those of ordinary skill in the art without making creative efforts shall fall within the protection scope of the present invention. Therefore, the detailed description of the embodiments of the present invention provided in the accompanying drawings is not intended to limit the scope of the claimed invention, but only to represent selected embodiments of the present invention. Based on the embodiments in the present invention, all other embodiments obtained by those of ordinary skill in the art without making creative efforts shall fall within the protection scope of the present invention.

Embodiments

With reference to FIG. 1 to FIG. 7, an embodiment provides a wall-wetting sprayer, including a rod body 11 provided with a water inlet flow channel 111 and a housing 12 sleeved on the rod body 11. A bottom surface of the housing 12 is provided with a spray hole 121, and a drainage surface 122 that inclines outward is formed along a circumference of the spray hole 121. The rod body 11 and the housing 12 are matched to form an acceleration cavity 13, and at least one water inlet groove 131 communicated with the water inlet flow channel 111 is formed along a circumferential direction of the acceleration cavity 13, to enable a water flow to rotate for acceleration after entering the acceleration cavity 13 from the water inlet groove 131, forming mist water to be spread and sprayed outward along the drainage surface 122 from the spray hole 121.

It should be noted that in the embodiment, after being accelerated by the acceleration cavity 13, the water flow can gain enough speed to be broken into small water drops or particles at the spray hole 121, forming the mist water to be sprayed toward an inner wall of a toilet to implement a wall-wetting function. The spray hole 121 is formed on a bottom surface of the rod body 11 to face a bottom portion of the toilet, so that the mist water can be sprayed on the inner wall of the toilet from top to bottom. Compared with the prior art, a spraying angle of the wall-wetting sprayer is not limited by a position of the spray hole 121. Meanwhile, the drainage surface 122 that inclines outward is formed along the circumference of the spray hole 121, so that the mist water can be spread and sprayed outward along the drainage surface 122, thereby increasing a spraying area, improving wall-wetting efficiency, and further improving a wall-wetting effect.

In a preferred embodiment, the spray hole 121 is formed along the center of the bottom surface of the housing 12 and is located at the center of the acceleration cavity 13, to ensure that the water flow can form the mist water at the spray hole 121, and the drainage surface 122 is an arc-shaped surface that is recessed from a periphery of an outer bottom surface of the housing 12 toward the spray hole 121. Preferably, the incurvate height of the drainage surface 122 is not greater than 0.5 mm, so that the water flow can spread better, avoiding water flow concentration and a small spraying range that are caused by the excessive height.

On the basis of the above embodiment, in an optional embodiment of the present invention, the water inlet flow channel 111 extends along an axial direction of the rod body 11, and a side surface of the water inlet flow channel 111 is provided with a water passing hole 112. A water passing channel 14 configured to be communicated with the water passing hole 112 is formed between an outer side wall of the rod body 11 and an inner side wall of the housing 12, and the acceleration cavity 13 is formed between an outer bottom surface of the rod body 11 and an inner bottom surface of the housing 12. Extension directions of the water inlet flow channel 111 and the water passing hole 112 are different, so that the structure is more compact. Preferably, the water inlet flow channel 111 is disposed with a cross section progressively decreasing along a water flow direction, so that a water flow entering the water inlet flow channel 111 is accelerated for a first time. Subsequently, the water flow flows into the water inlet groove 131 from the water passing channel 14 to be accelerated for a second time. Then the water flow enters the acceleration cavity 13 to rotate to be accelerated for a third time, thereby ensuring an atomizing effect of the water flow.

Further, an annular flange 113 is disposed along the outer bottom surface of the rod body 11, and the annular flange 113 abuts against the inner bottom surface of the housing 12 to form the acceleration cavity 13. The water inlet groove 131 is formed on the annular flange 113 and is obliquely formed along a circumferential direction of the annular flange 113. The annular flange 113 may be provided with two centrosymmetric water inlet grooves 131, to ensure that a vortex is formed in the acceleration cavity 13, thereby ensuring an acceleration effect. A direction of the water inlet groove 131 may be along a tangential direction of an inner wall of the annular flange 113, which is not limited thereto and is not specifically limited. Specifically, the diameter of the acceleration cavity 13 is set to 5 mm, and the height thereof is set to 0.4 mm. The width of the water inlet groove 131 is 0.5 mm, and the caliber of the spray hole 121 is 1.4 mm. The wall-wetting sprayer has a compact structure and small volume and is convenient to be adapted to a toilet cover 2 or a bidet, which is not limited thereto and is not specifically limited.

On the basis of the above embodiment, in an optional embodiment of the present invention, the rod body 11 is in threaded connection with the housing 12, and a sealing ring 15 configured to seal the water passing channel 14 is disposed above the water passing hole 112. The wall-wetting sprayer 1 has simple structures and only requires the rod body 11, the housing 12, and the sealing ring 15, and there are fewer parts, so that the costs can be saved. The threaded connection may facilitate disassembly and assembly between the rod body 11 and the housing 12.

Figure 8:
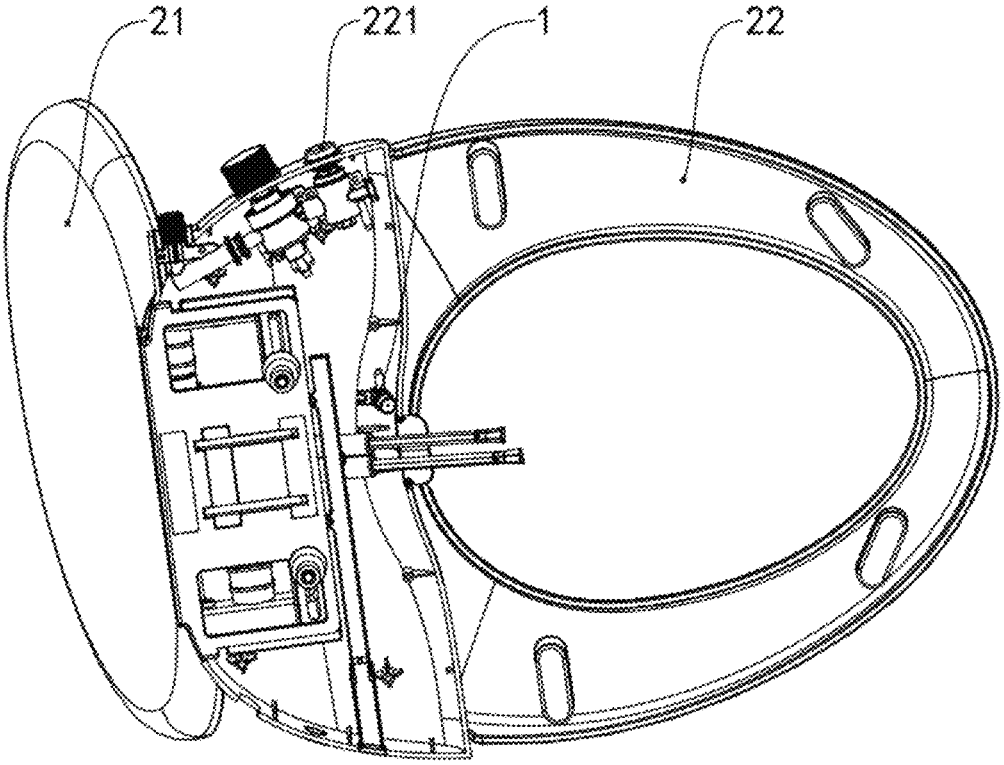
FIG. 8 is a schematic structural diagram of a smart toilet cover according to an embodiment of the present invention.
Figure 9:
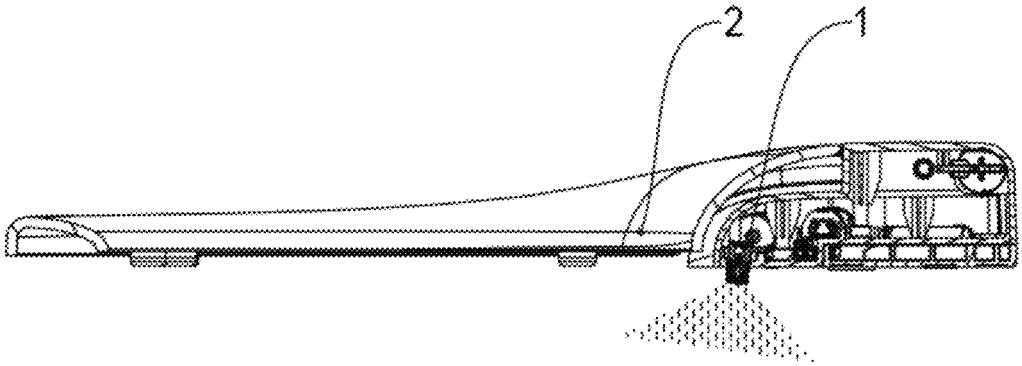
FIG. 9 is a schematic diagram of a water outflow of a wall-wetting sprayer disposed on a toilet cover according to an embodiment of the present invention.
Figure 10:
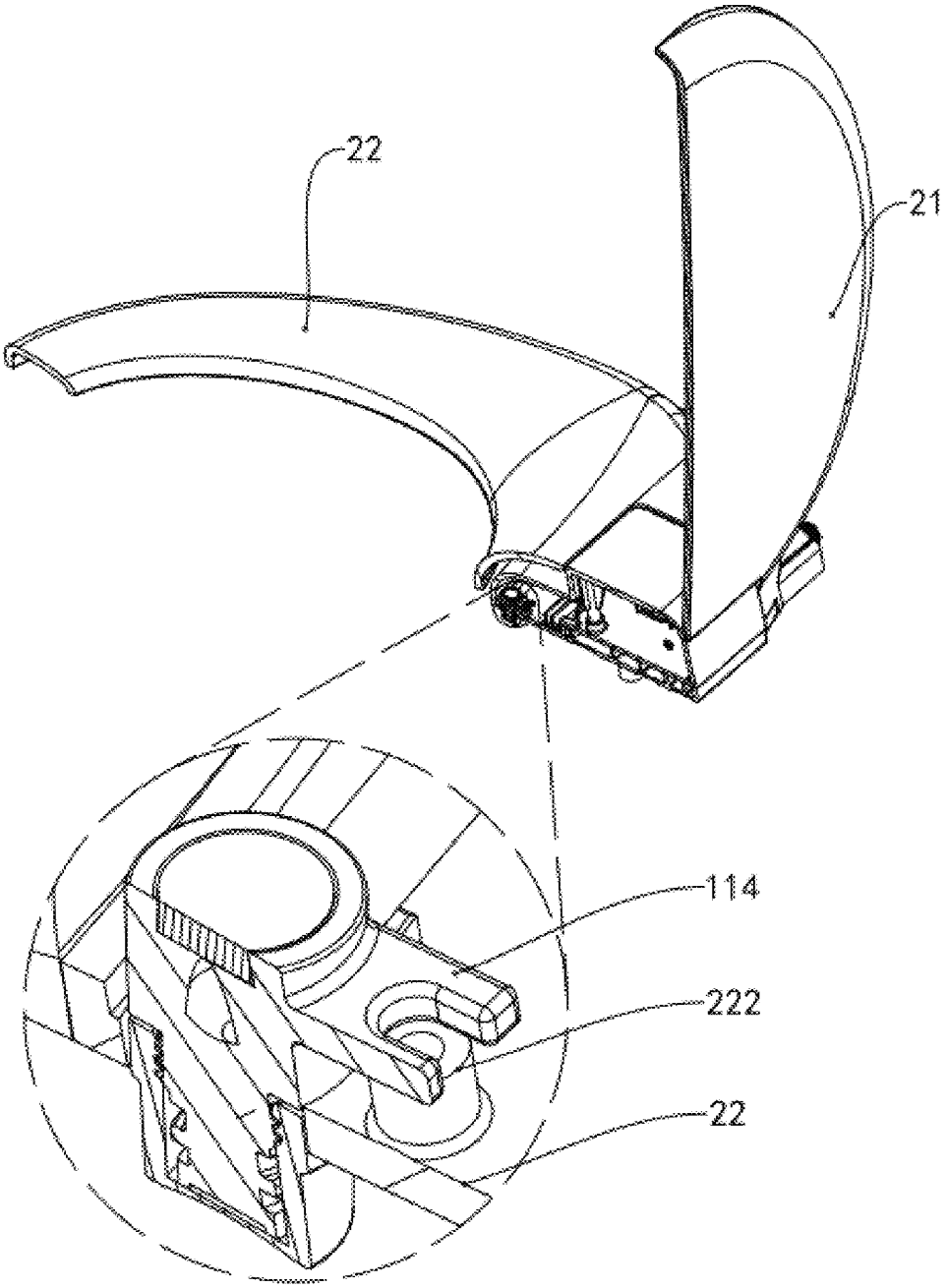
FIG. 10 is a sectional view of a smart toilet cover according to an embodiment of the present invention.
Figure 11:
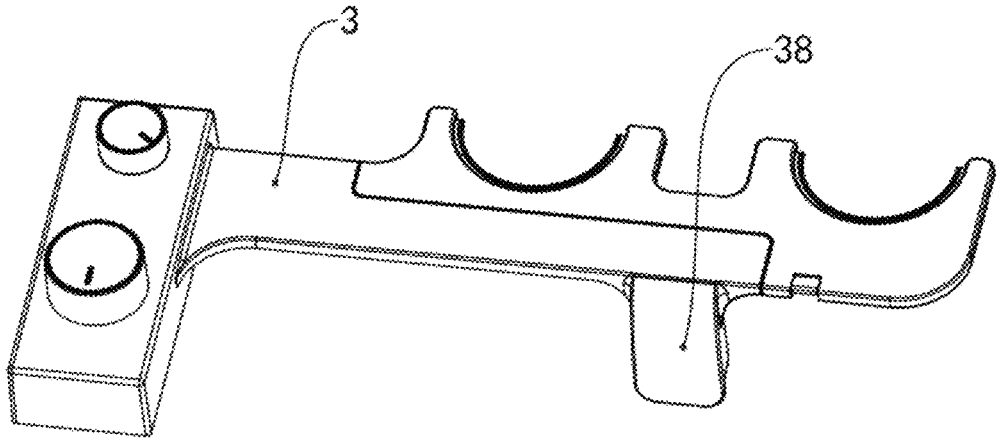
FIG. 11 and FIG. 12 are schematic structural diagrams of a bidet under different perspectives according to an embodiment of the present invention.
Figure 12:
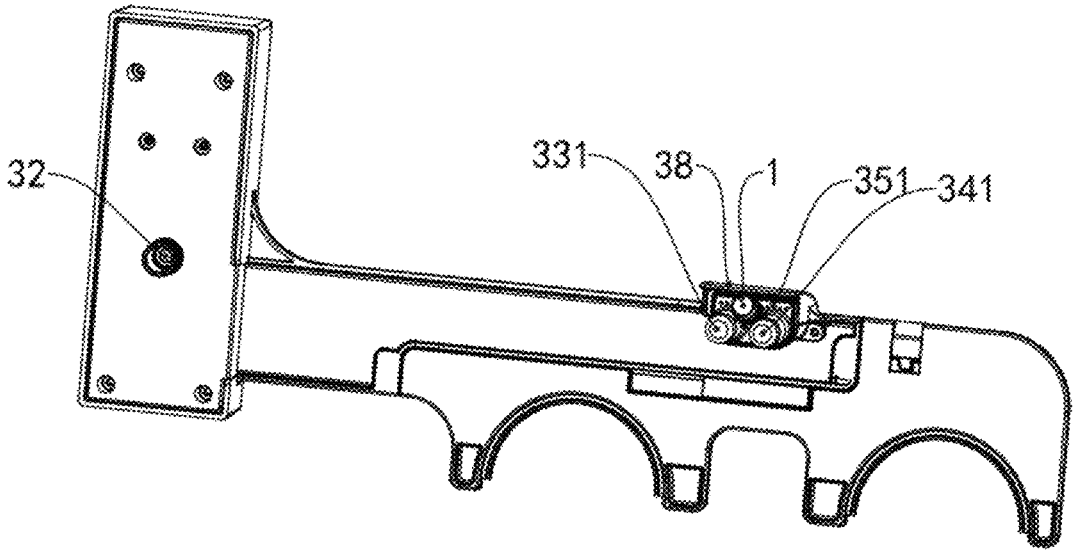
Figure 13:
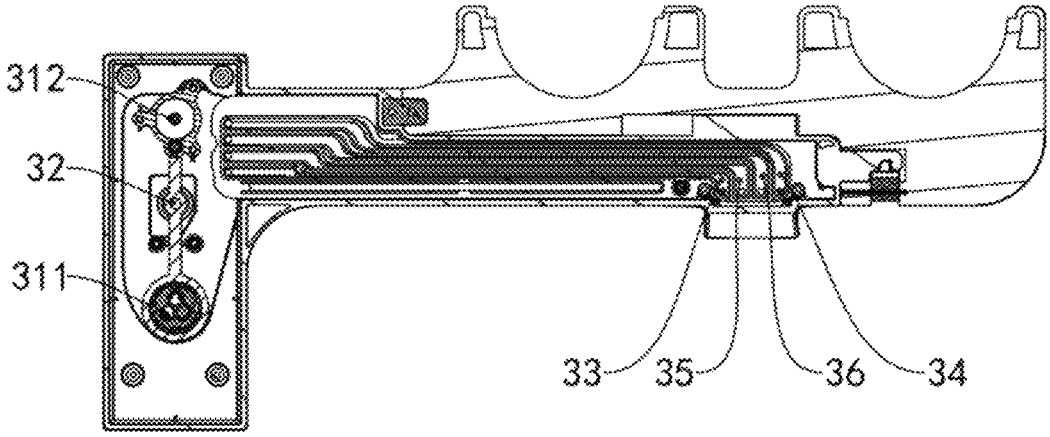
FIG. 13 to FIG. 16 are sectional views of a bidet along different cross sections according to an embodiment of the present invention.
Figure 14:
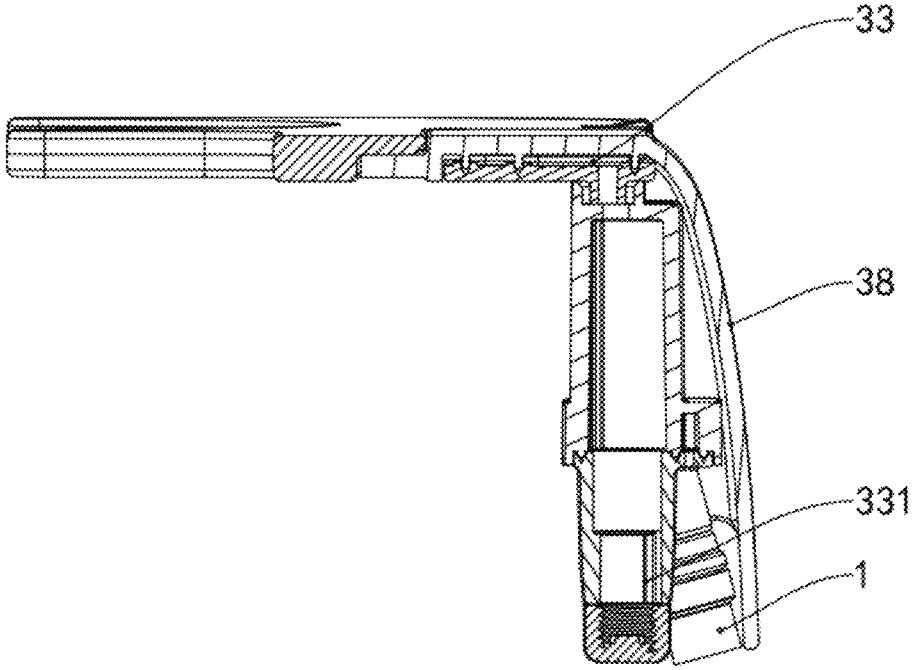
Figure 15:
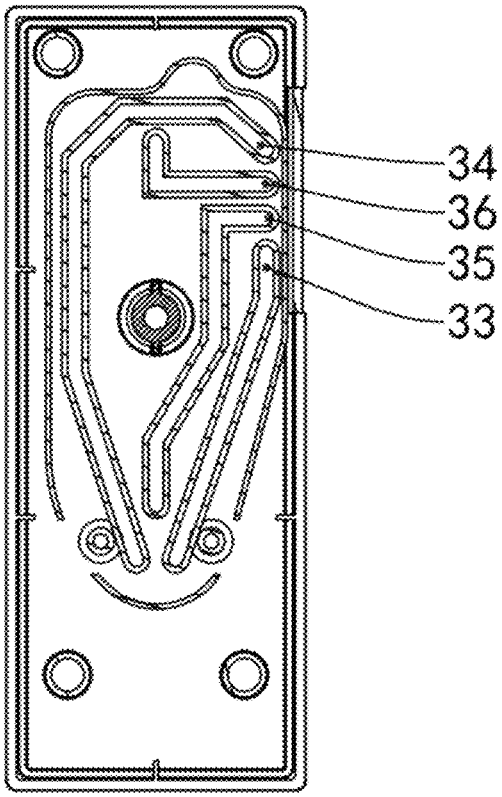
Figure 16:
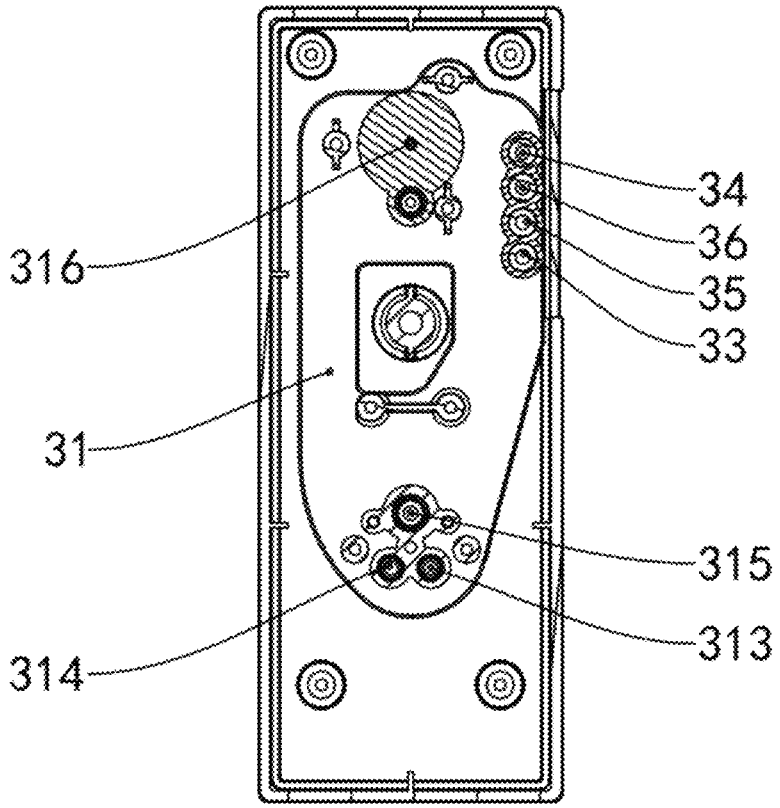
Figure 17:
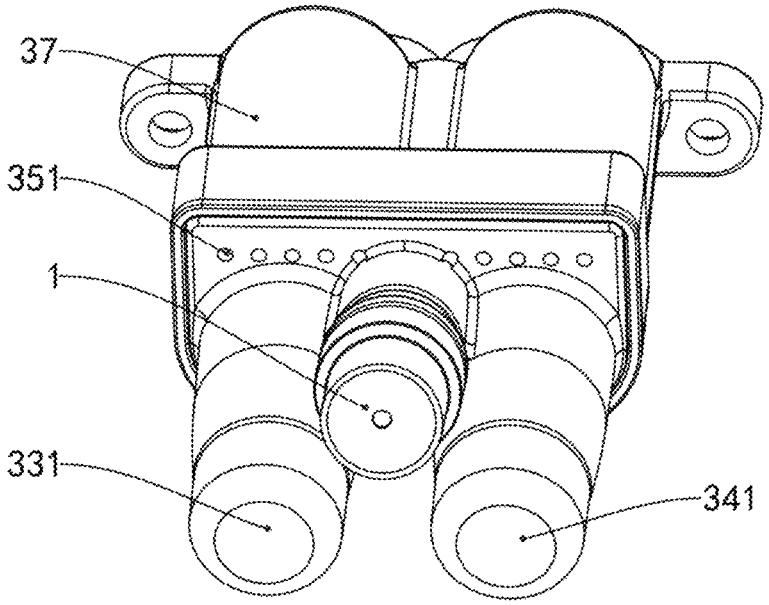
FIG. 17 to FIG. 18 are schematic structural diagrams of a nozzle seat under different perspectives according to an embodiment of the present invention.
Figure 18:
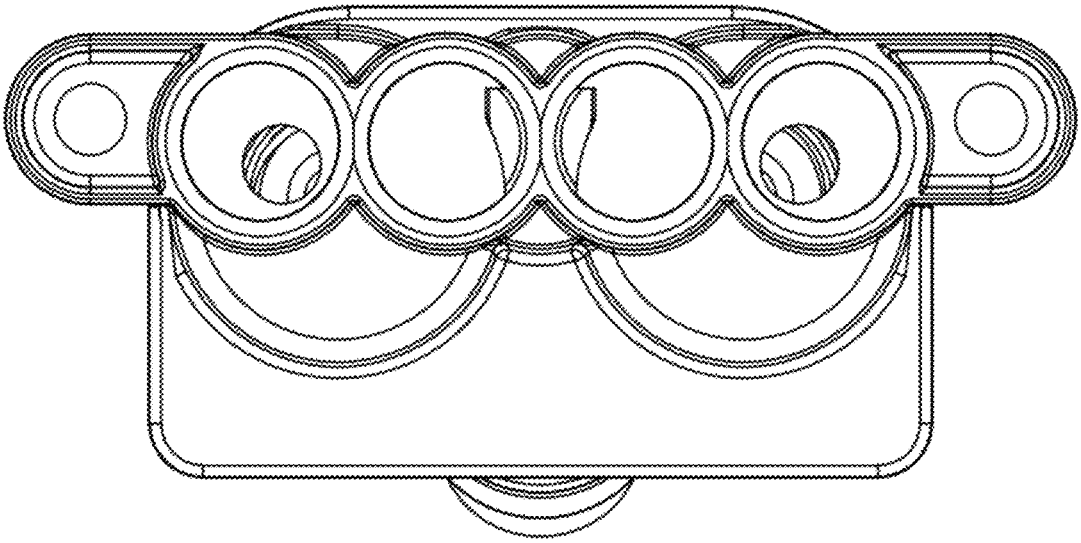
Figure 19:
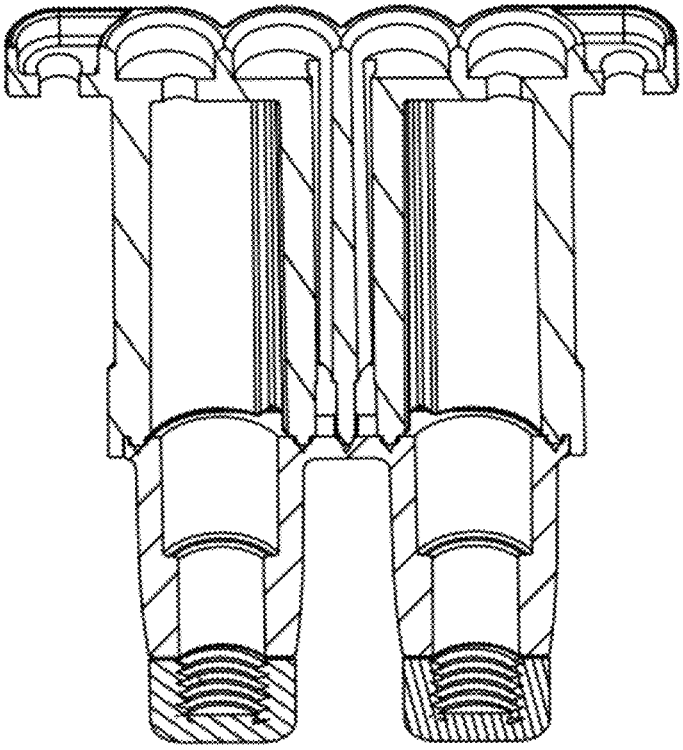
FIG. 19 and FIG. 20 are sectional views of a nozzle seat along different cross sections according to an embodiment of the present invention.
Figure 20:
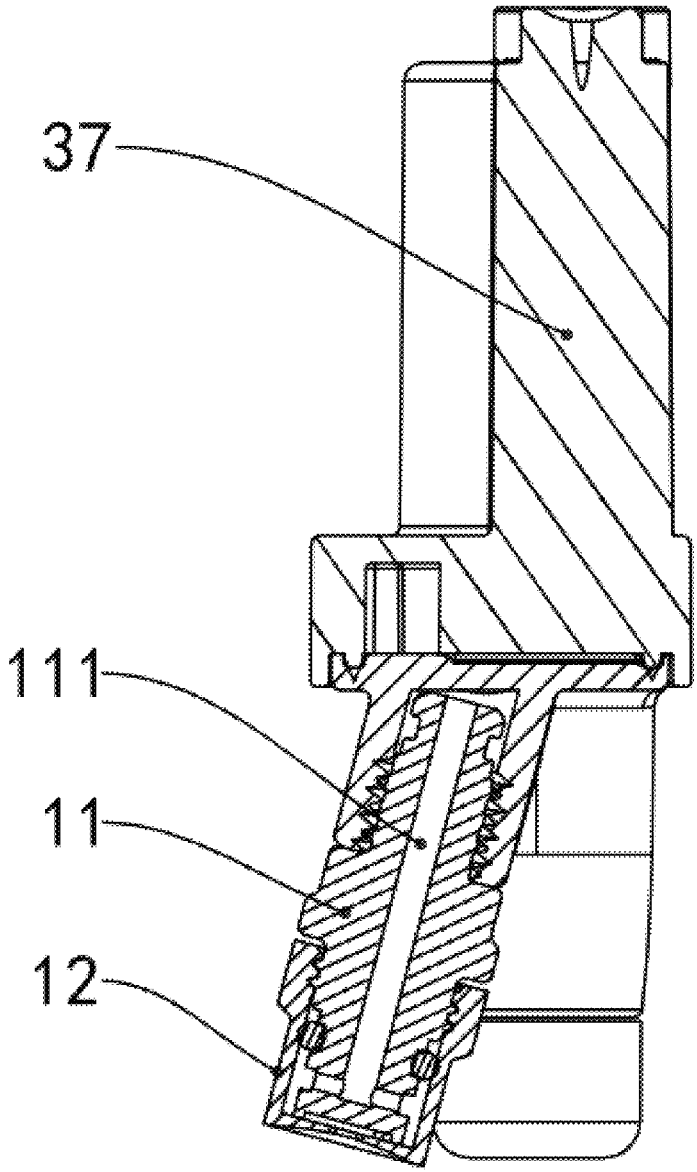
Figure 21:
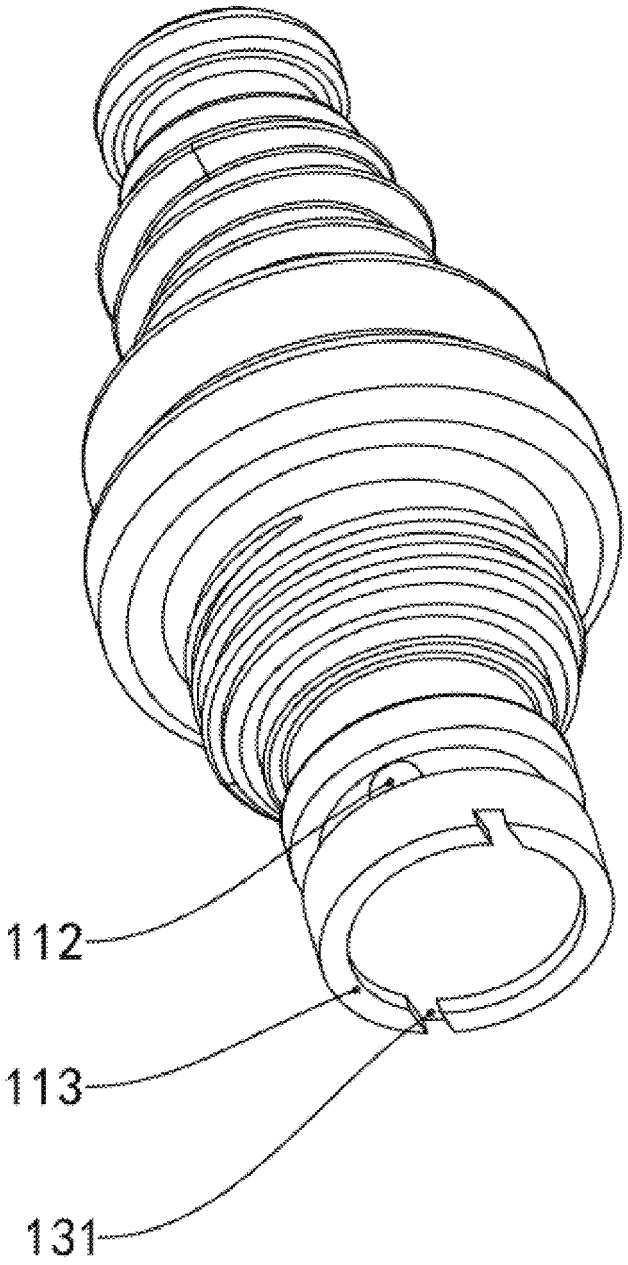
FIG. 21 is a schematic structural diagram of a spray rod according to an embodiment of the present invention.

With reference to FIG. 8 to FIG. 10, the present invention provides a smart toilet cover 2 additionally, including a cover plate 21, a seat plate 22, and the wall-wetting sprayer 1 according to any one of the above embodiments disposed on the seat plate 22. A switching valve 221 configured to control connection and disconnection between a water inlet pipe and the water inlet flow channel 111 is disposed on the seat plate 22. An assembly portion 114 and a water inlet portion 115 are disposed on an outer wall of the rod body 11 in a protruding manner. The assembly portion 114 is configured to be fixedly connected to the seat plate 22, and the water inlet portion 115 is communicated with the water inlet flow channel 111 and is connected to a water outlet end of a control valve through a hose. For example, the assembly portion 114 is provided with a U-shaped groove, and the seat plate 22 is provided with a screw post 222. During mounting, a screw passes through the U-shaped groove to be screwed with the screw post 222, thereby tightly pressing the assembly portion 114 and the screw post 222, so that the wall-wetting sprayer 1 is fixed. The water inlet portion 115 is tubular and is at an included angle of 90° to the assembly portion 114, to facilitate mounting and pipe connection, thereby avoiding interference between a mounting position and the pipe. In addition, the wall-wetting sprayer 1 may control a flow rate through the switching valve 221 to adjust a spraying range and may adapt to different water pressure, thereby reducing impacts of external water flow pressure on the wall-wetting effect.

With reference to FIG. 11 to FIG. 21, the present invention provides a bidet additionally, including a bidet main body configured to be fixed between a toilet seat and a seat plate 22 and the wall-wetting sprayer 1 according to any one of the above embodiments adapted and connected to the bidet main body. The bidet main body is provided with a valve cavity 31, a water inlet channel 32, a buttock washing flow channel 33, a feminine washing flow channel 34, a self-cleaning flow channel 35, and a pre-wetting flow channel 36. Outlet ends of flow channels are provided with a buttock washing nozzle 331, a feminine washing nozzle 341, a self-cleaning nozzle 351, and the wall-wetting sprayer 1 in a one-to-one correspondence. A first control valve 311 and a second control valve 312 are disposed in the valve cavity 31. The first control valve 311 is configured to choose one flow channel from the buttock washing flow channel 33, the feminine washing flow channel 34, and the self-cleaning flow channel 35 to be communicated with the water inlet channel 32, and the second control valve 312 is configured to control connection and disconnection between the pre-wetting flow channel 36 and the water inlet channel 32.

For example, a mounting seat is assembled on the bidet main body. The mounting seat is configured to be clamped and adapted to the screw fixing the seat plate 22, to enable the bidet main body to be fixed between the toilet seat and the seat plate 22, which has no impact on the toilet seat and the seat plate 22, is convenient for disassembly and assembly, and facilitates application in the aftermarket. The valve cavity 31 is provided with a first water distribution chamber configured to assemble the first control valve 311 and a second water distribution chamber configured to assemble the second control valve 312. Both water inlet ends of the two water distribution chambers are communicated with the water inlet channel 32. The first water distribution chamber is provided with a first water outlet 313, a second water outlet 314, and a third water outlet 315 that are communicated with the buttock washing flow channel 33, the feminine washing flow channel 34, and the self-cleaning flow channel 35 respectively, and the second water distribution chamber is provided with a fourth water outlet 316 communicated with the pre-wetting flow channel 36. The first control valve 311 is configured to control connection and disconnection between the water inlet channel 32 and the buttock washing flow channel 33, the feminine washing flow channel 34, and the self-cleaning flow channel 35. The second control valve 312 is configured to control connection and disconnection between the pre-wetting flow channel 36 and the water inlet channel 32. Therefore, a water outflow of the wall-wetting sprayer 1 is controlled independently, it is convenient for a user to start a wall-wetting function before using a toilet, and the pre-wetting flow channel 36 and other flow channels can be switched on simultaneously. Both control valves are disposed to avoid a misoperation of the user, thereby further facilitating use of the user. Specifically, the first control valve 311 is a ceramic changeover valve, and the second control valve 312 is a ceramic switching valve 221. An internal structure of a ceramic valve is the prior art, which is described in detail herein again. Both control valves are mechanical valves and do not need to be connected to a power supply, which is conducive to mounting in a bathroom without a socket, reduces mounting costs of the user, and improves the market competitiveness of the bidet. In addition, compared with the smart toilet cover 2, the bidet has low costs and high cost performance and has no restrictions on shapes of the toilet seat and the seat plate 22, which is more conducive to being mounted on the existing toilet, to facilitate application of the wall-wetting function in the aftermarket.

In another embodiment, the buttock washing nozzle 331, the feminine washing nozzle 341, the self-cleaning nozzle 351, and the wall-wetting sprayer 1 are all disposed on a nozzle seat 37. The nozzle seat 37 is connected and fixed to the bidet main body 3 through a screw. The buttock washing nozzle 331 is spaced from the feminine washing nozzle 341 along a vertical direction, and the wall-wetting sprayer 1 is disposed between the buttock washing nozzle 331 and the feminine washing nozzle 341 and is configured to incline toward a user side, so that the wall-wetting sprayer 1 can spray toward a pot surface of the toilet, thereby pre-wetting the pot surface and avoiding dirt hanging. The structure is compact to ensure a size of the nozzle seat 37, so that the bidet is simpler and more aesthetic in appearance. A decorative cover 38 configured to shelter the nozzle seat 37 may be further disposed on the bidet main body, and the buttock washing nozzle 331 and the feminine washing nozzle 341 are disposed as telescopic nozzles. Telescopic structures of the telescopic nozzles are the prior art and are not described in detail herein again. The buttock washing nozzle 331 and the feminine washing nozzle 341 are concealed in the decorative cover 38 when closed and extend outward to be exposed to the decorative cover 38 when opened, so that spray openings can be concealed when closed, thereby preventing a bacteria breeding problem caused by the exposed spray openings.

The above are only preferred embodiments of the present invention. The protection scope of the present invention is not limited to the above embodiments, and all technical solutions under the concept of the present invention fall within the protection scope of the present invention.

What is claimed is:

1. A wall-wetting sprayer, comprising a rod body provided with a water inlet flow channel and a housing sleeved on the rod body, wherein a bottom surface of the housing is provided with a spray hole, a drainage surface that inclines outward is formed along a circumference of the spray hole, the rod body and the housing are matched to form an acceleration cavity, and at least one water inlet groove communicated with the water inlet flow channel is formed along a circumferential direction of the acceleration cavity, to enable a water flow to rotate for acceleration after entering the acceleration cavity from the water inlet groove, forming mist water to be spread and sprayed outward along the drainage surface from the spray hole.

2. The wall-wetting sprayer according to claim 1, wherein the spray hole is formed along a center of the bottom surface of the housing and is located at a center of the acceleration cavity, and the drainage surface is an arc-shaped surface that is recessed from a periphery of an outer bottom surface of the housing toward the spray hole.

3. The wall-wetting sprayer according to claim 1, wherein the water inlet flow channel extends along an axial direction of the rod body, a side surface of the water inlet flow channel is provided with a water passing hole, a water passing channel configured to be communicated with the water passing hole is formed between an outer side wall of the rod body and an inner side wall of the housing, and the acceleration cavity is formed between an outer bottom surface of the rod body and an inner bottom surface of the housing.

4. The wall-wetting sprayer according to claim 3, wherein an annular flange is disposed along the outer bottom surface of the rod body, the annular flange abuts against the inner bottom surface of the housing to form the acceleration cavity, and the water inlet groove is formed on the annular flange and is obliquely formed along a circumferential direction of the annular flange.

5. The wall-wetting sprayer according to claim 3, wherein the rod body is in threaded connection with the housing, and a sealing ring configured to seal the water passing channel is disposed above the water passing hole.

6. The wall-wetting sprayer according to claim 4, wherein the rod body is in threaded connection with the housing, and a sealing ring configured to seal the water passing channel is disposed above the water passing hole.

7. The wall-wetting sprayer according to claim 1, wherein the water inlet flow channel is disposed with a cross section progressively decreasing along a water flow direction.

8. A smart toilet cover, comprising a cover plate, a seat plate, and the wall-wetting sprayer according to claim 1 disposed on the seat plate, wherein a switching valve configured to control connection and disconnection between a water inlet pipe and the water inlet flow channel is disposed on the seat plate.

9. The smart toilet cover according to claim 7, wherein an assembly portion and a water inlet portion are disposed on an outer wall of the rod body in a protruding manner, the assembly portion is configured to be fixedly connected to the seat plate, and the water inlet portion is communicated with the water inlet flow channel and is connected to a water outlet end of a control valve through a hose.

10. A bidet, comprising a bidet main body configured to be fixed between a toilet seat and a seat plate and the wall-wetting sprayer according to claim 1 adapted and connected to the bidet main body.

11. The bidet according to claim 9, wherein the bidet main body is provided with a valve cavity, a water inlet channel, a buttock washing flow channel, a feminine washing flow channel, a self-cleaning flow channel, and a pre-wetting flow channel, outlet ends of flow channels are provided with a buttock washing nozzle, a feminine washing nozzle, a self-cleaning nozzle, and the wall-wetting sprayer in a one-to-one correspondence, a first control valve and a second control valve are disposed in the valve cavity, the first control valve is configured to choose one flow channel from the buttock washing flow channel, the feminine washing flow channel, and the self-cleaning flow channel to be communicated with the water inlet channel, and the second control valve is configured to control connection and disconnection between the pre-wetting flow channel and the water inlet channel.

* * * * *